United States Patent [19]

Bastian

[11] 4,021,811

[45] May 3, 1977

[54] QUAD ANTENNA SUPPORT

[76] Inventor: Erich Bastian, Lohrbergweg 20, 53 Bonn-Beuel, Germany

[22] Filed: Aug. 13, 1975

[21] Appl. No.: 604,184

[30] Foreign Application Priority Data

Aug. 19, 1975 Germany ..... 2439708

[52] U.S. Cl. ..... 343/742; 343/880

[51] Int. Cl.[2] ..... H01Q 7/02

[58] Field of Search ..... 343/880, 881, 882, 896, 343/741, 742, 803

[56] References Cited

UNITED STATES PATENTS

| | | | |
|---|---|---|---|
| 1,820,643 | 8/1931 | Arias | 343/896 |
| 3,532,315 | 10/1970 | Partridge | 343/742 |

*Primary Examiner*—Eli Lieberman

*Attorney, Agent, or Firm*—Craig & Antonelli

[57] ABSTRACT

A quad antenna for short-wave or ultra-short wave range employs at least one radiator element and an associated reflector element. Each element is fixed in position by a respective holding member. The holding members are mounted at a point in the center of the base plane of a cube formed by the corner points of the elements.

4 Claims, 5 Drawing Figures

QUAD ANTENNA SUPPORT

FIELD OF THE INVENTION

The present invention relates to a quad antenna with at least one radiating element and an associated reflector element and optionally a director element, wherein the element holders retaining the elements in their positions are made to converge in one mounting point.

BACKGROUND OF THE INVENTION

The quad antenna, also called cubical quad, is a directional wire antenna. The basic element is a radiator 11 constructed in the manner of a square, see FIG. 1. The side length 9 is $\lambda/4$. The entire wire length is thus $1\lambda$ (wavelength). At a distance A of $0.15 - 0.20\ \lambda$ a second, identical wire quadrangle is disposed, which is somewhat larger dimensions, about $1.03 - 1.05\ \lambda$, this latter component acting as a reflector 21. This increase in length of the reflector element 21 is frequently produced, while maintaining the same dimensions of the square as in case of the associated radiator, by means of an inserted extension piece, e.g. a wire bracket maintained at the same distance, the stub 8, or in the form of a wire section wound into a coil. A quad antenna wherein the reflector element has its full length is called, in contrast thereto, a "full-phased reflector." The quad antennas radiate in a horizontally polarized manner if fed at the base point, i.e. at the point of the radiator closest to the ground (earth). In contrast thereto, if fed laterally, they would radiate in a vertically polarized manner.

To obtain a further gain in the efficiency of the antenna, it is also possible, in addition to the provision of reflectors, to employ so-called director elements. While the reflectors are longer than the radiators and thereby act on the radiator by an inductive phase shift, the directors are shorter than the radiator and effect a capacitive phase shift. The power gain attainable by these unfed elements, namely the reflectors and directors, depends on the spacing with respect to the radiator. As already set forth above, the reflector distance to the radiator ranges between 0.10 and $0.25\ \lambda$, while the spacing of the director to the radiator is between 0.10 and $0.15\ \lambda$.

Moreover, the distance between the radiator and the reflector and director, respectively, is decisive for the base impedance of the antenna, for the antenna gain in the radiation direction, and for the forward-backward ratio of the antenna. Desirable as the base impedance is 50–60 ohms, i.e. a value maximally corresponding to the value of the resistance of the feeder cable 7, i.e. a coaxial cable connecting transmitter and antenna. The smaller the distance between the elements, radiator, director, reflector, the lower the base impedance. The feed 7 of the antenna can be direct or indirect, depending on the respective requirements, wherein the indirect feeding is carried out by way of a balun or via the so-called gamma adapter, that is a frequency-linked adapting element for asymmetrical feeder cables with adjustable resistance. Feeding by means of a balun, though, has the purpose of obtaining symmetry, in order to prevent thereby the so-called squinting of the antenna.

The quad antenna can be constructed as a single-band or multiband antenna with two, three, four, or even five elements; in other words, one or more directors are arranged additionally to the radiator and reflector. Mechanical problems are encountered during the construction of the antenna, in that the elements, i.e. two, three, or even four or five wire squares of large dimensions must be arranged in series at accurate spacings. The entire arrangement must be lightweight, rugged in its construction, and erectable in a mechanically simple and safe fashion. If the quad antenna is furthermore to be usuable for more than one band, i.e. for several frequencies, then several wire squares of varying sizes must be mounted as the elements. Conventional structures of a quad antenna utilize a braced cross with spreaders 3 as shown in FIG. 1, attached to a horizontal mounting pipe 10. For each element, one braced cross is required; several taut wire squares for various bands (frequencies) can be provided at one braced cross. The elements, i.e. the wire quadrangles, are attached to the braced cross so that they are insulated; it is desirable to employ, if at all possible, no metal for the entire mounting structure, except for the feeder cable in the antenna. In case of side lengths of the wire squares of 5 meters and more (for example 20 m, band), considerable mechanical difficulties result, since the antenna must be assembled on the ground, where it is level, and then is attached to the masthead above the ground.

Another conventional construction of a quad antenna operates with spreaders in spider form, i.e. without a mounting pipe, wherein all element spreaders meet in the center of the cube. Also in case of this antenna, the preliminary assembly takes place on level ground, and considerable difficulties are encountered in mounting the antenna in the assembled condition to the masthead, inasmuch as it must be attached in its entirety from above onto the masthead so as not to destroy the wire squares, i.e. the elements. High masts are required for the spider quad antenna as well as for the braced cross quad antennas, ensuring the necessary distance from the ground and a free rotation. A subsequent tuning of the element is impossible without removing the antenna from the mast.

A modification of a quad antenna is the delta loop antenna operating with a horizontal mounting pipe and biased on this triangular element. The delta loop antenna is susceptible to wind forces and cannot be used as a multiband antenna, utilizing the same spreaders for all bands, since the spreaders here function simultaneously as the element.

BRIEF DESCRIPTION OF THE INVENTION

The present invention is based on the problem of providing a quad antenna which can be readily assembled, disassembled, and tuned to the frequency.

The quad antenna of this invention is characterized in that the mounting point of all element holders is disposed in the center of the basal plane of the cube formed by the corner points of the elements. In this way, the construction of a quad antenna is possible which can be readily assembled, disassembled, and tuned to the frequency. The guad antenna can be constructed as a multiband antenna for transmission and reception in the short-wave range, making it possible to provide spacings of identical proportions for the radiator-reflector in any frequency band. With high mechanical strength, the construction can proceed conveniently and safely from the mounting point, i.e. directly from the masthead. In contrast thereto, the conventional quad antennas must all be assembled, due to their particular structure, on level ground and must then be conveyed, in the assembled condition, to the masthead. Tuning operations on the elements can be effected without the danger of an accident only if the entire arrangement is again taken off the mast and lowered to a safe support.

In a further development of this invention, the mounting point for the element holders is fashioned as a mounting head of metal and/or a synthetic resin, rotatable on the mast. To insert the element holders, the mounting head is preferably provided with plug-in holes in the basal plane and in two planes extending upwardly under the same, steep angle. In case of small mounting heads, the plug-in holes can be disposed within the mounting head, while in case of large mounting apertures, these can be fashioned as projecting tubes. It is also possible to effect the fastening of the elements by means of mounting angles.

The construction of the quad antenna according to this invention can serve as a multiband antenna for the transmission and receiving operation in the short-wave range, as well as for the ultrashort-wave range including VHF and UHF.

DETAILED DESCRIPTION

Figure 1:
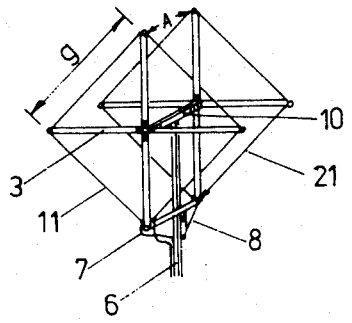
Fig. 1 PRIOR ART
FIG. 1 depicts in perspective the fundamental construction of a quad directional wire antenna.
Figure 2:
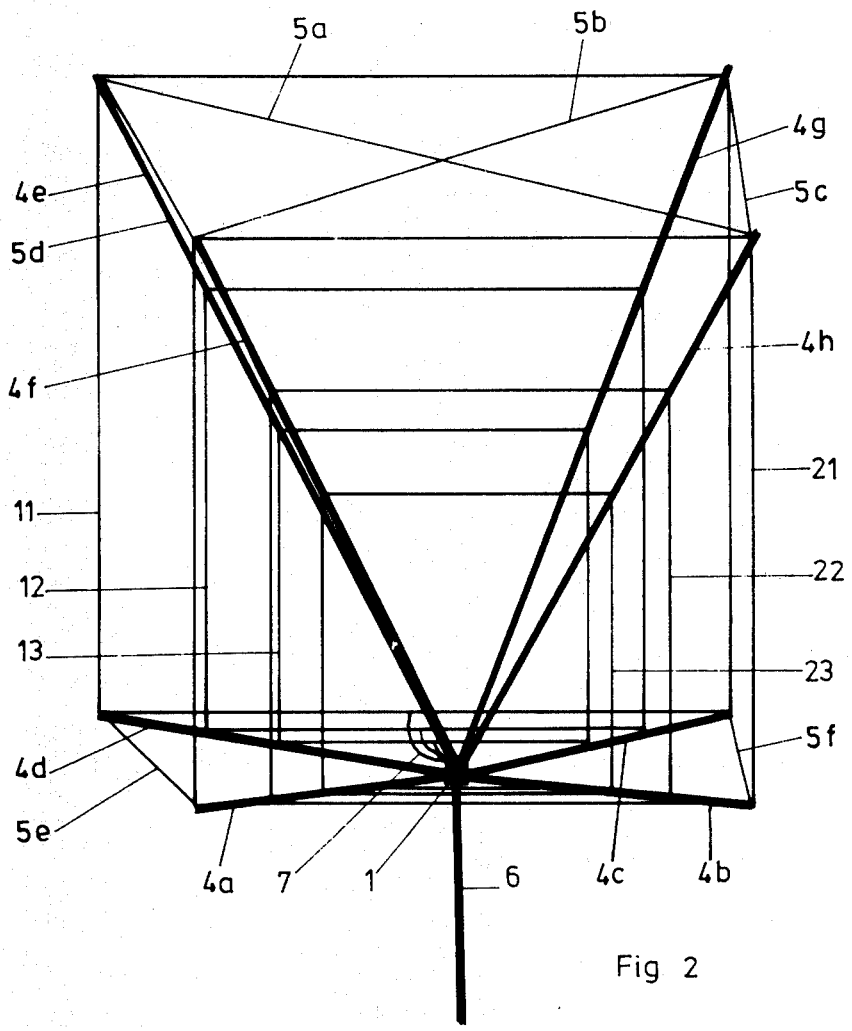
FIG. 2 depicts in perspective the quad antenna according to the present invention.
Figure 3:
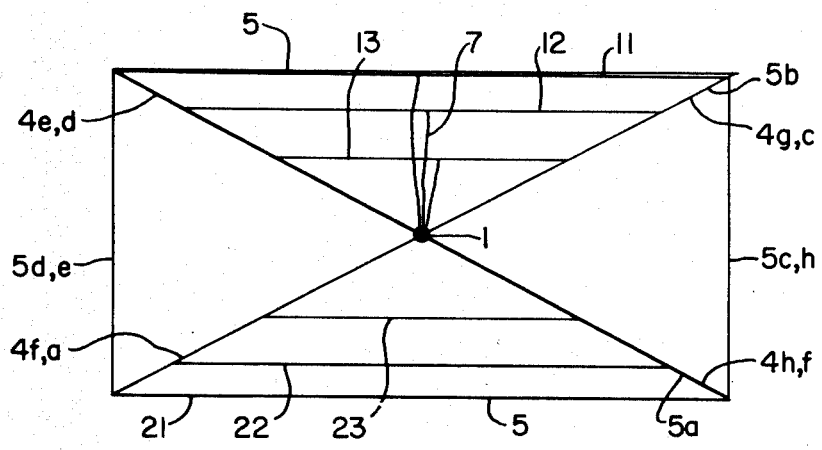
Figure 4:
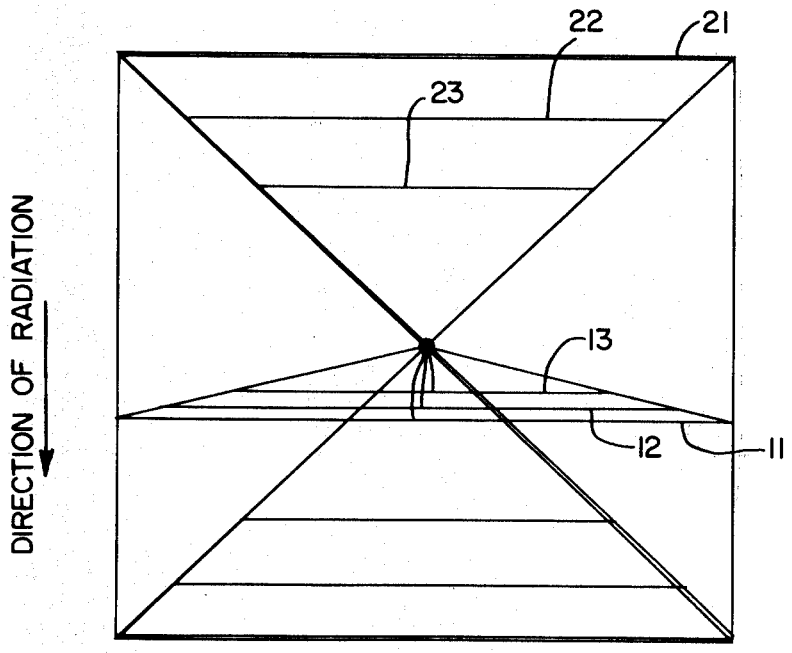
Figure 5:
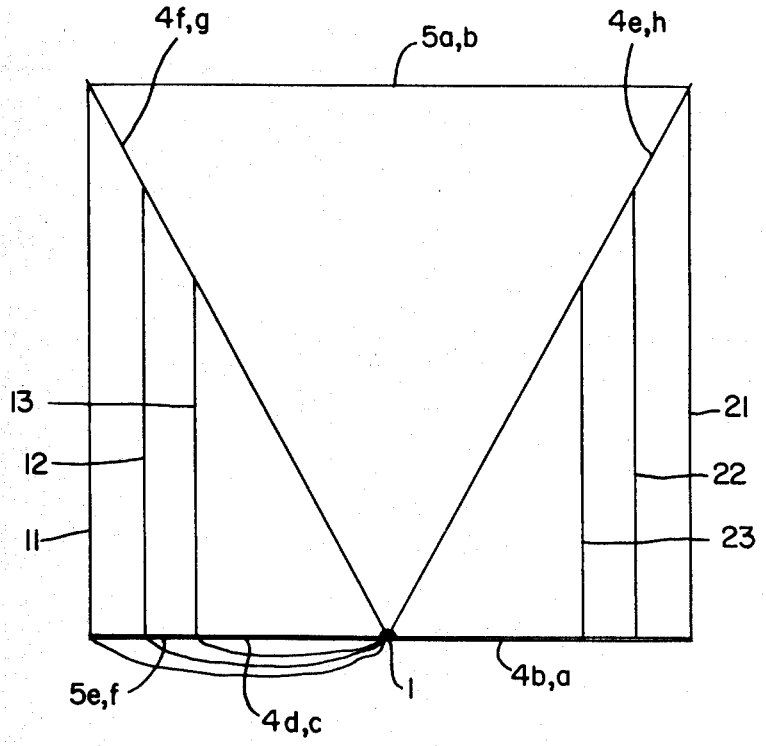

The present invention is illustrated in FIG. 2 of the drawings, using as example a two-element quad antenna for three frequency bands, and will be explained in greater detail with reference thereto. The structure of a quad antenna schematically shown in FIG. 2 illustrates the construction of this invention in connection with a two-element quad for three frequency bands, i.e. respectively one radiator element and one reflector element for each band. The rotatable mounting head 1, constructed of steel or a synthetic resin, is attached to the top of the mast 6. The entire quad antenna is then constructed on top of this mounting head lying in the center of the basal plane of the cube formed by the antenna elements. The element holders 4 consist, for example, of nonconductive glass fiber tubes and could readily be made also of an equivalent material, e.g. bamboo rods. The element holders can be a continuous rod or they can be made of various, plugged-in segments. The element holders 4 carry the elements, per frequency band respectively one radiator 11, 12, 13 and one reflector 21, 22, 23, consisting of a stranded copper wire extended in a square. The spacing between the radiator and the reflector is determined constructionally by the rotatable mounting head, i.e. by the mutual position of the element holders 4*a* through 4*h*, which position is fixed in the mounting head 1. This spacing is possible to produce for each band of 0.1 to 0.25 λ. Two long element holders 4*e*, 4*g*, extending obliquely upwardly, form the upper corner spacing of the radiator extended in a square, and two shorter, horizontal element holders 4*d*, 4*c* form the lower corner spacing. The reflector is held by identically shaped element holders 4*f*, 4*h*, and 4*a*, 4*b*, arranged in mirror-image relationship to the element holders of the radiator. Elements for various frequencies can be attached to the same element holders. The element holders are joined together by silk cords 5*a* through 5*f* to increase the mechanical strength. The series-disposed square elements, radiators 11, 12, 13 and reflectors 21, 22, 23 show even under great wind forces a high staying power with concomitant flexibility. The construction can also be assembled on the ground, but especially on the mast. An assembly without the risks of accidents is also possible on the mast, since each element holder is attached individually and is always connected to the subsequent or already standing element. By releasing the shorter, horizontal element holders 4*a*, 4*b*, 4*c*, 4*d*, each element can be pulled toward the rotatable holding member, so that tuning operations or a renewal of the feed can be executed on the mast without difficulties. The radiators are fed via the coaxial cable 7 in the zone of the basal plane, by means of balun or gamma adaption.

The mounting angle for the elements depends on the measure of distance for the radiator and the reflector and essentially determines the mode of operation and the appearance of the antenna. Also a three-element design, reflector-radiator-direction, can be realized by the same principle.

As contrasted to the heretofore very cumbersome arrangements of such an antenna, the single-or multiband quad antenna constructed in accordance with the present invention for transmission and reception operations in the short-wave range makes it possible to provide a convenient and safe system. The antenna can be tuned more easily and can also be disassembled more readily. Identical λ-spacings for radiator-reflector in each frequency band are made possible, and a high mechanical strength is ensured even in case of a full-size (large-size) antenna.

What I claim is:

1. Quad antenna for short-wave or ultrashort-wave range, including VHF and UHF, comprising at least one radiating element and an associated reflector element disposed to form a cube, and element holder means including a plurality of element holders for retaining the radiating and reflector elements in their positions, said element holders being mounted to converge in a single mounting point located in the center of the base plane of the cube formed by the corner points of the radiating and reflector elements.

2. Quad antenna according to claim 1, characterized in that the mounting point for the element holders is fashioned as a mounting head made of a metal and/or a synthetic resin and rotatable on a mast.

3. Quad antenna according to claim 2, characterized in that the mounting head is fashioned with plug-in holes for inserting the element holders in the basal plane so as to extend in two planes upwardly under a steep angle.

4. Quad antenna according to claim 1, further including at least one director element supported by said element holder means on the side of said radiator opposite said reflector.

* * * * *